US006400084B1

(12) United States Patent
Eisemann

(10) Patent No.: US 6,400,084 B1
(45) Date of Patent: Jun. 4, 2002

(54) METAL HALIDE LAMP

(75) Inventor: Hans Eisemann, Berlin (DE)

(73) Assignee: Patent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/499,099

(22) Filed: Feb. 4, 2000

(30) Foreign Application Priority Data

Feb. 22, 1999 (DE) ..... 199 07 301

(51) Int. Cl.[7] ..... H01J 17/20; H01J 61/18

(52) U.S. Cl. ..... 313/640; 313/637; 313/567; 313/571

(58) Field of Search ..... 313/640, 639, 313/638, 637, 567, 571, 25

(56) References Cited

U.S. PATENT DOCUMENTS 4,678,960 A * 7/1987 Rilling ..... 313/25
4,859,899 A * 8/1989 Keeffe et al. ..... 313/25
5,698,948 A * 12/1997 Caruso ..... 313/637

FOREIGN PATENT DOCUMENTS

| | | | |
|---|---|---|---|
| DE | 2925410 | 1/1981 | ..... H01J/61/09 |
| EP | 0543169 | 5/1993 | ..... H01J/61/18 |
| GB | 2059146 | 4/1981 | ..... H01J/61/12 |
| JP | 1128345 | 5/1989 | ..... H01J/61/20 |

* cited by examiner

*Primary Examiner*—Sandra O'Shea
*Assistant Examiner*—Ali Alavi
(74) *Attorney, Agent, or Firm*—William H. McNeill

(57) ABSTRACT

A metal halide lamp for general illumination purposes contains as the essential component of the metal halide fill manganese in an amount of from 0.01 to 50 $\mu$mol per $cm^3$. It serves as a replacement for sodium at warm white or neutral white luminous colors.

16 Claims, 3 Drawing Sheets

METAL HALIDE LAMP

TECHNICAL FIELD

The invention is based on a metal halide lamp according to the preamble of claim 1. It relates in particular to metal halide lamps with a discharge vessel made from quartz glass or ceramic, which is often accommodated in an outer bulb.

1. Prior Art

DE-A 43 27 534 has already disclosed a metal halide lamp which uses as its fill, for photo-optical purposes, $AlI_3$ and/or $AlBr_3$ together with metal halides of thallium, cesium and/or rare-earth metals for high color temperatures of over 5000 K.

In metal halide lamps which are used as UV emitters, iron is frequently used as the most important UV-radiation source. In this connection, it is known, for example from EP-B-543,169, to add other UV-emitters, such as manganese, bismuth, thallium or tin, in order to avoid the blackening which is formed with iron.

To achieve warm white and neutral white luminous colors with color temperatures of below 5000 K, metal halide discharge lamps often contain sodium. For example, U.S. Pat. No. 3,575,630 describes a fill containing halides of the metals Na, Tl and Zr. Metal halide discharge lamps with a discharge vessel made from glass and a sodium-containing fill have the drawback that sodium diffuses through the discharge vessel, with the result that the service life of the lamps is reduced. The diffusion of sodium has to be reduced by additional measures, for example by shielding the supply conductor in the vicinity of the discharge vessel. This increases the production costs of the lamp. A further drawback of sodium-containing metal halide discharge lamps is their relatively poor color rendering. Typical values are $R_a$=70 for the general color rendering index and $R_9$=0 for the specific red color rendering index.

2. Description of the Invention

The object of the present invention is to provide a metal halide lamp according to the preamble of claim 1, which contains very little or no sodium and in particular yet nevertheless provides a color temperature of below 5000 K (corresponding to a warm white or neutral white luminous color).

This object is achieved by means of the characterizing features of claim 1. Particularly advantageous configurations are given in the dependent claims.

According to the invention, the metal halide fill contains as the principal or only constituent manganese in the form of Mn halide. As an alternative to the known utilization of the intensive spectral lines in the UV range, the spectral lines of manganese in the visible spectral range are for the first time used to improve the general color rendering index $R_a$. As a result of (possibly substantially) dispensing with the use of sodium, it is possible to do without the additional measures for reducing the diffusion of sodium. The improved red rendering ($R_9$) is attributable primarily to the fact that there is a series of Mn lines in the wavelength range of greater than 603 nm.

A particular advantage is that the UV radiation of manganese can additionally be used to increase the temperature of the discharge vessel. This is achieved by producing an envelope (which is often an additional outer bulb and/or the discharge vessel itself) from UV-impermeable material, for example from hard glass or doped quartz glass. The UV radiation is thus absorbed in the envelope and is to a large extent returned to the discharge vessel. Consequently, the temperature of the cold spot is increased, which is of benefit to the light efficiency. With manganese as the only metal halide, it is typically possible to achieve a very high color temperature of more than 8000 K at a high $R_a$ of more than 90. In total, it is possible to achieve an $R_a$>95 and an $R_9$>90.

Advantageously, manganese is combined with further halides of the elements Cs, Dy, Tl, Ho, Tm and, if appropriate, small quantities of sodium. In this case, the molar ratio Mn/Na should be >1, preferably >2. In this case, Mn is used to completely or partially substitute Na, because significant spectral lines of Mn lie in the visible spectral range, very close to the sodium-D lines. These fills containing a plurality of components are eminently suitable for use in general illumination to produce warm white or neutral white luminous colors with a color temperature of between approximately 3000 and 4500 K. Manganese forms in this case an essential component of the metal halide fill; in particular its proportion amounts to at least 20% by weight of the entire metal halide fill.

Preferably, the amount of Mn in the fill is from 0.01 to 50 $\mu$mol per $cm^3$ of the volume of the discharge vessel.

In a particularly preferred embodiment, up to 30 $\mu$mol per $cm^3$ of Cs are added to the fill. As an alternative, or in addition, one or more of the following components (usually in halide form) are added to the fill: up to 35 $\mu$mol per $cm^3$ of Dy, and/or up to 15 $\mu$mol per $cm^3$ of Tl, and/or up to 18 $\mu$mol per $cm^3$ of Ho, and/or up to 18 $\mu$mol per $cm^3$ of Tm. It is thus possible to fine-tune the desired $R_a$ and $R_9$.

The halogens used to form halides are preferably iodine and/or bromine.

Advantageously, the volume between discharge vessel and outer bulb is evacuated. It is thus possible to achieve a particularly high color rendering index $R_a$. As an alternative, the volume between the discharge vessel and outer bulb may contain a gas fill, in particular inert gas, which results in an increase in the service life. In a particularly preferred embodiment, the gas fill comprises from 10 to 90 kPa $N_2$ (cold) or from 5 to 70 kPa $CO_2$ (cold).

FIGURES

The invention is to be explained in more detail below with reference to a plurality of exemplary embodiments. In the drawing:

FIG. 1 shows a side view of a metal halide lamp;

FIG. 2 shows the spectrum of a metal halide lamp with a manganese-containing fill;

FIG. 3 shows the spectrum of a metal halide lamp with a fill comprising a plurality of components.

DESCRIPTION OF THE DRAWINGS

An exemplary embodiment of a metal halide lamp 1 with an output of 250 W is diagrammatically illustrated in FIG. 1. The figure shows a discharge vessel 2 which is pinched on two sides and is surrounded by a cylindrical, evacuated outer bulb 3 made from hard glass (UV-impermeable), which is capped on one side. One end of the outer bulb 3 has a rounded top 4, whereas the other end has a screw cap 5. A holding frame 6 fixes the discharge vessel 2 axially inside the outer bulb 3. The holding frame 6 essentially comprises two power-supply wires 7, 8, the shorter (7) of which is connected to that supply conductor 9 of the discharge vessel 2 which is at the cap end. The long power-supply wire 8 is essentially a solid metal support wire which extends along the discharge vessel 2 and leads to the supply conductor 10 which is at the other end from the cap. The ends 15 of the discharge vessel 2 are provided with a heat-reflecting coating 16. In addition, a plurality of getters 14 are welded to the holding frame 6.

The volume of the discharge vessel 2 is approx. 5.2 $cm^3$. The distance between the two electrodes 11, 12 is 27.5 mm. The discharge vessel contains 56 mbar argon as the basic gas.

The outer bulb is evacuated and is thus provided with good thermal insulation, resulting in a particularly good color rendering. To increase the service life, the outer bulb may contain a gas fill. Inert gas ($N_2$ or $CO_2$), for example with a cold filling pressure of 70 kPa $N_2$ or 50 kPa $CO_2$, is particularly suitable. In this case, however, it is necessary to accept a slightly worse color rendering.

Figure 1:
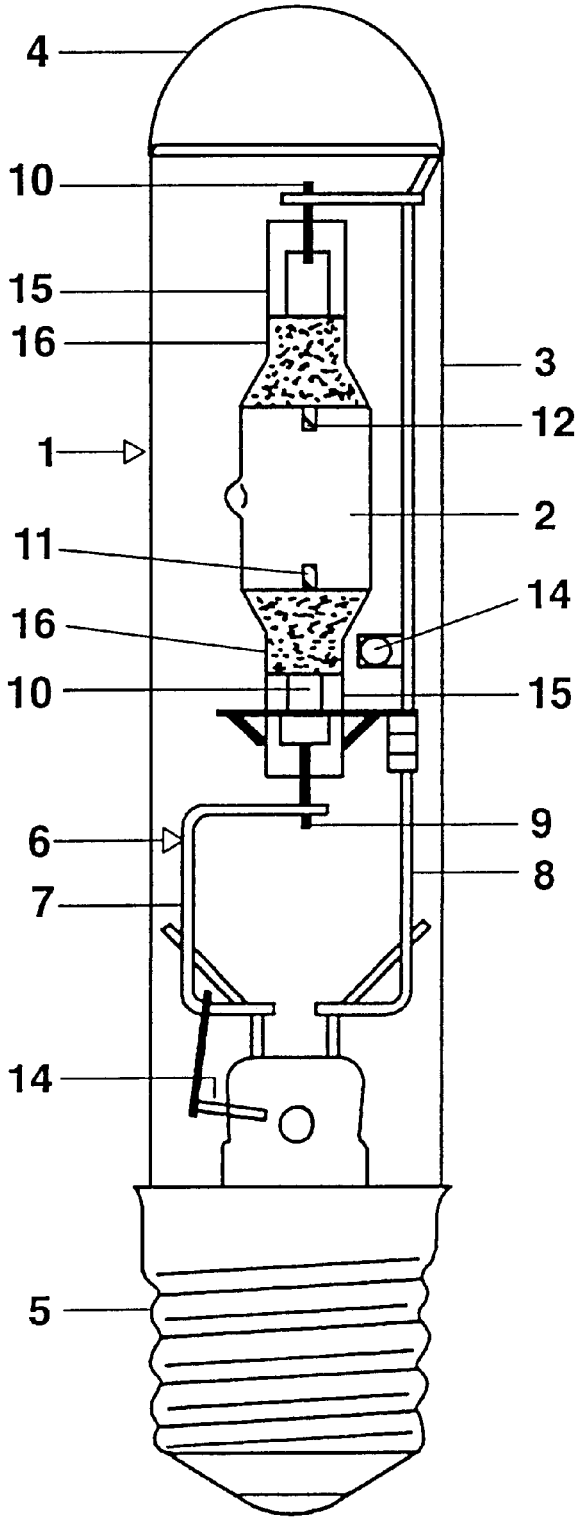
Figure 2:
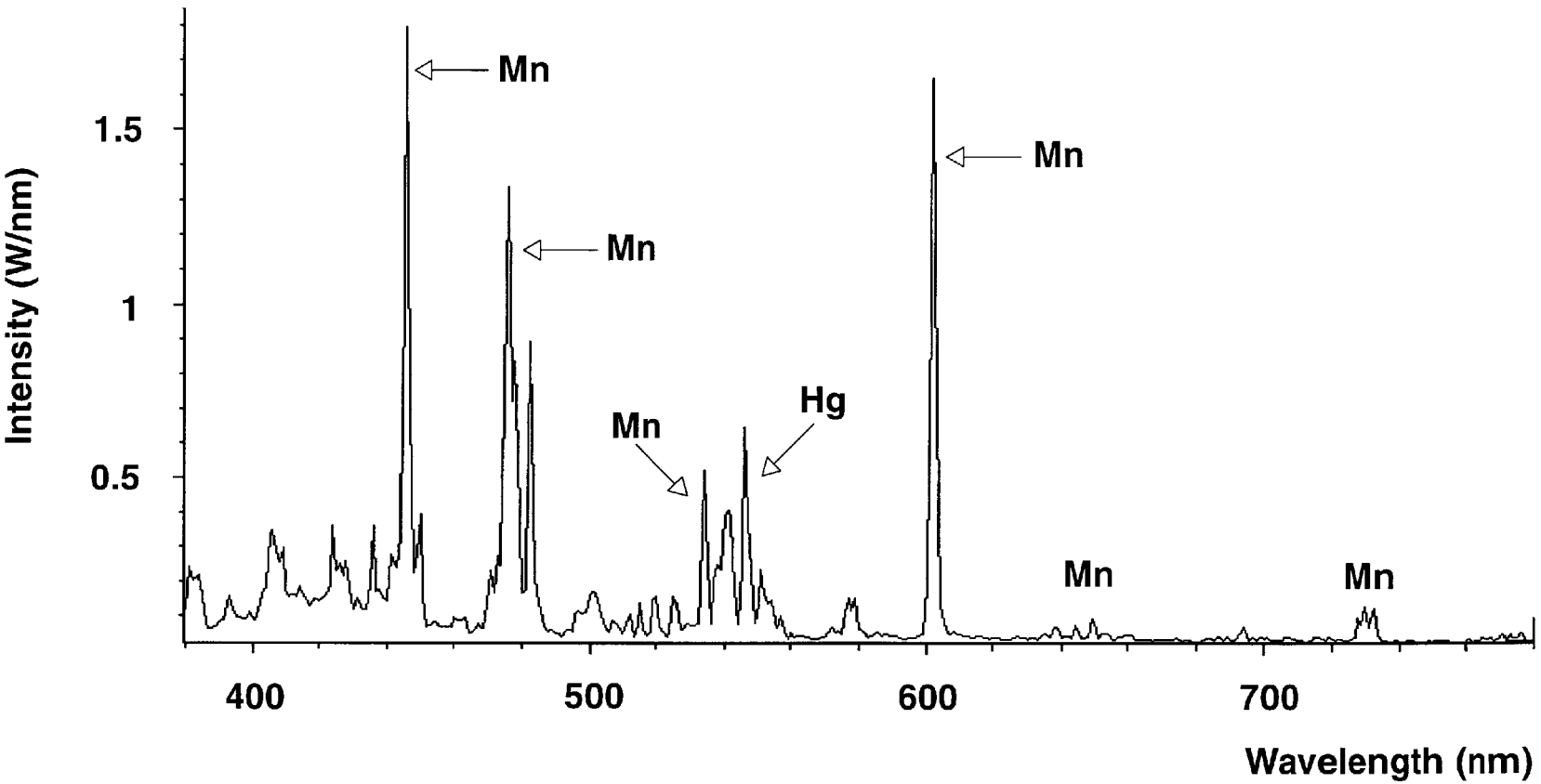

FIG. 2 shows the spectrum of a lamp in accordance with the first exemplary embodiment, the discharge volume containing 16 mg Hg and 3.4 mg $MnI_2$. Selected spectral lines of Mn and Hg are marked. According to FIG. 2, Mn has, inter alia, an intensive group of spectral lines in the range from 601 to 603 nm, so that it is possible to produce lamps with a warm white to neutral white luminous color (similar to that achieved with an Na-containing fill), since Na has its most intensive spectral lines at a wavelength of approximately 589 nm. Moreover, the spectrum from FIG. 2 shows that Mn has numerous groups of lines in the visible spectral range at wavelengths of greater than 603 nm, and these lines are suitable for improving the red rendering. Further usable groups of lines lie in the short-wave range between about 450 and 550 nm.

In this exemplary embodiment, a color temperature of at least 8000 K and a general color rendering index $R_4$=91 are reached. However, the luminous efficiency is relatively low, at around 34 lm/W.

Figure 3:
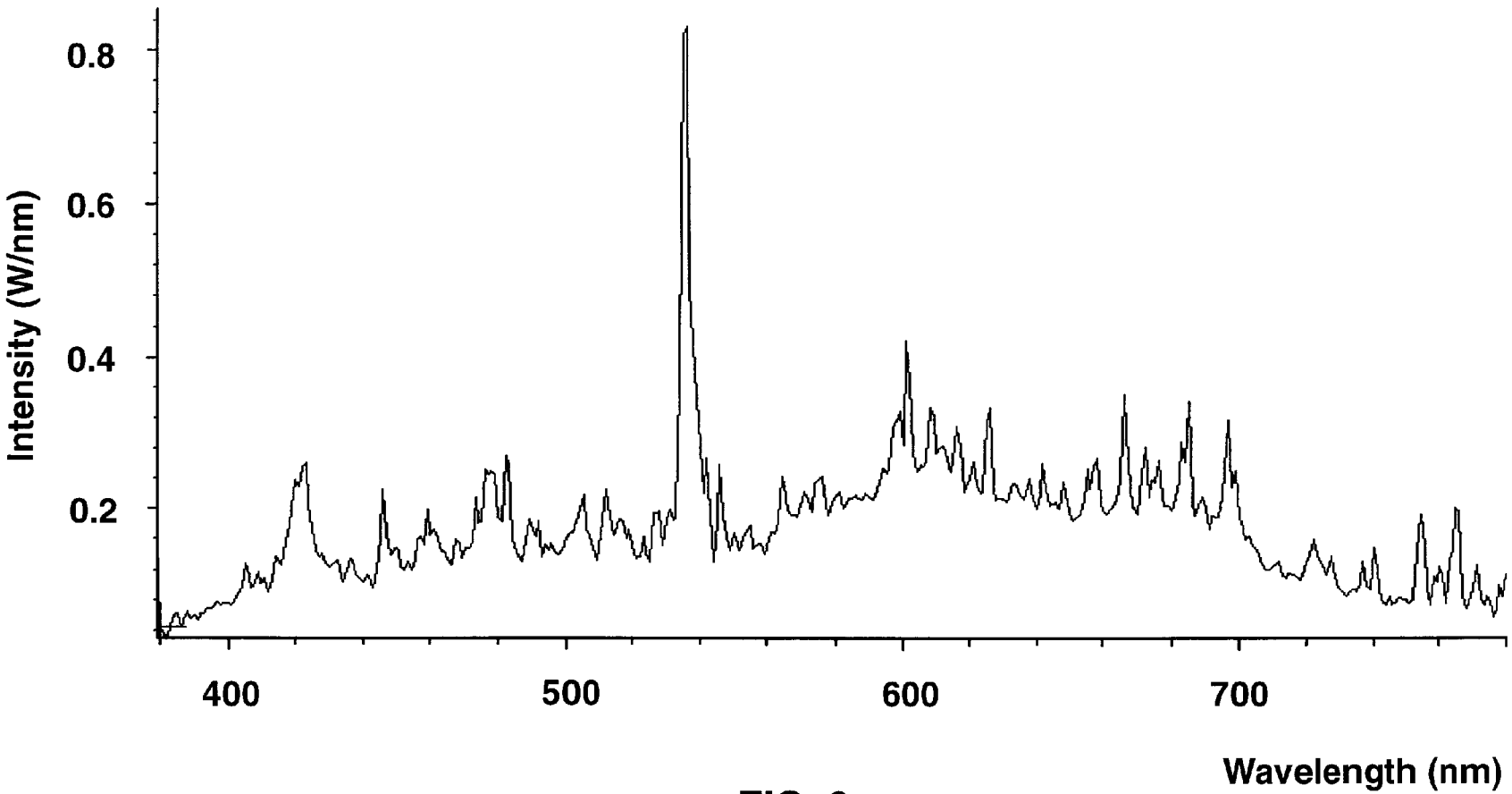

In a second exemplary embodiment, 14 mg Hg and a total of 10.4 mg of metal halides were selected as the fill for the same discharge volume. In detail, the halides contained therein are: 18% by weight CsI, 36.8% by weight $DyI_3$, 12.5% by weight TlI and 32.7% by weight $MnI_2$. The spectrum of this lamp is shown in FIG. 3.

This lamp provides a color temperature of 4400 K. It has a general color rendering index $R_a$=96, a specific red color rendering index $R_9$=92 and a light efficiency of around 60 lm/W. This lamp therefore has a considerably better color rendering than sodium-containing metal halide fills.

A lower color temperature of typically 4200 K to down to about 3900 K may be achieved with a metal halide fill consisting of CsI (14.7% by weight), $DYI_3$ (30.0% by weight), TlI (10.2% by weight),$HoI_3$ (9.2%), $TmI_3$ (9.2) and $MnI_2$ (26.7%). In a further exemplary embodiment the metal halide fill consists of CsI (11.5% by weight), $DYI_3$ (31.2% by weight), TiI (10.6%), $HoI_3$ (9.5%), $TmI_3$ (9.5%) and $MnI_2$ (27.7%).

What is claimed is:

1. A metal halide lamp for use in the visible spectral range with a color rendering index of Ra>80, the discharge vessel (2) containing two electrodes (11, 12) and an ionizable fill comprising inert gas, mercury and at least one metal halide, wherein the principal or only metal halide used is a halide of Mn.

2. The metal halide lamp as claimed in claim 1, wherein in order to reach a color temperature of below 5000 K at least one halide selected from the group of metals consisting of Cs, Dy, Tl, Ho, Tm, and, if appropriate, Na is also present in small quantities.

3. The metal halide lamp as claimed in claim 1, wherein the amount of Mn in the fill amounts to from 0.01 to 50 $\mu$mol per $cm^3$ of the volume of the discharge vessel.

4. The metal halide lamp as claimed in claim 2, wherein from 0 to 30 $\mu$mol of Cs per $cm^3$ of the volume of the discharge vessel is added to the fill.

5. The metal halide lamp as claimed in claim 2, wherein from 0 to 35 $\mu$mol of Dy per $cm^3$ of the volume of the discharge vessel is added to the fill.

6. The metal halide lamp as claimed in claim 2, wherein from 0 to 15 $\mu$mol of Tl per $cm^3$ of the volume of the discharge vessel is added to the fill.

7. The metal halide lamp as claimed in claim 2, wherein from 0 to 18 $\mu$mol of Ho per $cm^3$ of the volume of the discharge vessel is added to the fill.

8. The metal halide lamp as claimed in claim 2, wherein from 0 to 18 $\mu$mol of Tm per $cm^3$ of the volume of-the discharge vessel is added to the fill.

9. The metal halide lamp as claimed in claim 1, wherein iodine and/or bromine are used as the halogens for forming halides.

10. The metal halide lamp as claimed in claim 1, wherein the fill is surrounded by a UV-impermeable envelope (3), in particular an outer bulb.

11. The metal halide lamp as claimed in claim 10, wherein the volume between discharge vessel (2) and outer bulb (3) is evacuated.

12. The metal halide lamp as claimed in claim 10, wherein the volume between discharge vessel (2) and outer bulb (3) contains a gas fill, in particular inert gas.

13. The metal halide lamp as claimed in claim 12, wherein the gas fill comprises from 10 to 90 kPa $N_2$ (cold).

14. The metal halide lamp as claimed in claim 1, wherein the gas fill comprises from 5 to 70 kPa $CO_2$ (cold).

15. The metal halide lamp as claimed in claim 2, wherein the proportion of the Mn halide amounts to at least 20% by weight of the entire metal halide fill.

16. The metal halide lamp as claimed in claim 1, wherein in order to reach a color temperature of over 8000 K a halide of the Mn is used as sole metal halide.

* * * * *